US007490419B1

(12) United States Patent
Weiland

(10) Patent No.: US 7,490,419 B1
(45) Date of Patent: Feb. 17, 2009

(54) SUPPORT DEVICES FOR DISTRIBUTING PRESSURE

(75) Inventor: Dennis E. Weiland, 9905 E. San Salvador Dr., Scottsdale, AZ (US) 85258

(73) Assignee: Dennis E. Weiland, Scottsdale, AZ (US)

( * ) Notice: Subject to any disclaimer, the term of this patent is extended or adjusted under 35 U.S.C. 154(b) by 985 days.

(21) Appl. No.: 11/025,708

(22) Filed: Dec. 29, 2004

(51) Int. Cl.
*A43B 13/38* (2006.01)

(52) U.S. Cl. ..... 36/110; 36/71; 36/81; 36/43

(58) Field of Classification Search ..... 36/43, 36/44, 71, 110, 28, 81
See application file for complete search history.

(56) References Cited

U.S. PATENT DOCUMENTS 2,265,869 A * 12/1941 Scholl ..... 36/81
3,566,487 A * 3/1971 Beightol ..... 36/110
3,905,135 A * 9/1975 Debusk ..... 36/110
4,700,403 A * 10/1987 Vacanti ..... 2/462
4,727,660 A * 3/1988 Bernhard ..... 36/88
4,888,225 A * 12/1989 Sandvig et al. ..... 428/71
5,334,646 A 8/1994 Chen
5,336,708 A 8/1994 Chen
5,469,639 A * 11/1995 Sessa ..... 36/28
5,545,129 A * 8/1996 Snook ..... 602/66
5,611,153 A * 3/1997 Fisher et al. ..... 36/43
5,695,245 A 12/1997 Carlson et al.
5,761,834 A * 6/1998 Grim et al. ..... 36/88
5,797,862 A * 8/1998 Lamont ..... 602/10
5,961,477 A 10/1999 Turtzo
6,110,134 A 8/2000 Clark et al.
6,187,837 B1 2/2001 Pearce
6,254,554 B1 7/2001 Turtzo
6,315,786 B1 11/2001 Smuckler
6,458,090 B1 10/2002 Walpin
6,485,446 B1 11/2002 Brother et al.
6,602,579 B2 8/2003 Landvik
6,634,045 B1 10/2003 DuDonis et al.
6,701,529 B1 3/2004 Rhoades et al.
2002/0007136 A1 1/2002 Narula et al.
2002/0169401 A1 11/2002 Walpin
2003/0088998 A1* 5/2003 Boncutter et al. ..... 36/11.5
2003/0162000 A1 8/2003 Landvik
2003/0196352 A1 10/2003 Bledsoe et al.
2003/0200675 A1* 10/2003 Gross ..... 36/15
2003/0217485 A1 11/2003 Oidhi et al.
2004/0019972 A1 2/2004 Schecter et al.
2004/0039316 A1 2/2004 Smith
2004/0049827 A1 3/2004 Melts
2005/0060908 A1* 3/2005 Vito et al. ..... 36/25 R
2005/0066545 A1* 3/2005 Peoples ..... 36/43

* cited by examiner

*Primary Examiner*—Marie Patterson

(57) ABSTRACT

A method and device to provide support devices to distribute pressure over a contact area; for example, an insole support device to distribute pressure over the insole of a person's foot are described. The support device is a visco-elastic material having a sufficient density and thickness to provide a relatively uniform pressure to the insole when compressed.

19 Claims, 5 Drawing Sheets

SUPPORT DEVICES FOR DISTRIBUTING PRESSURE

FIELD OF THE INVENTION

The present invention relates to the field of generally to the field of medical devices and more particularly to support devices to distribute pressure over a contact area; for example, an insole support device to distribute pressure over the insole of a person's foot.

BACKGROUND

The present invention relates to support devices where support of a part of a person's body is desired. The support device is a visco-elastic material of a plastic foam type for suitably distributing the pressure from a high pressure areas over a relatively large area contacted by the support device. Examples of visco-elastic materials are made by many companies; for example, Sleep Innovation Inc. (187 Route 36 Suite 201 West Long Branch, N.J.) makes a polyurethane material of a foam type.

It is well known that the various parts of the body may be subject to injuries and by pressure induced ulcerations, and by other conditions such as sores (decubitus), wounds and planar fascitis. For example, these conditions are sometimes suffered when persons are immobilized or suffer from a medical disorder such as diabetes. For example, diabetics are prone to develop pressure induced ulcerations from walking. Likewise, immobilized patients often develop decubitus (sometimes know as bed sores). Often, these ulcerations and sores are difficult to heal.

A need exists to make a support device that can used to more evenly distribute pressure the foot (insole), heel, leg, butt (ischeal), back (secral), elbow, arm, scalp, or halo (head) of a patient to prevent, treat and heal decubitus, and relieve pain of planar fascitis. Further, a need exists to make a support device that can easily be adapted to a person's foot and footwear.

Information relevant to address these needs can be found in U.S. Pat. Nos. 6,701,529; 6,602,579; 6,634,045; 6,485,446; 6,458,090; 6,315,786; 6,254,554; 6,187,837; 6,110,134; 5,961,477; 5,695,245; 5,336,708; and 5,334,646; and 20020007136; 20020169401; 2003016200; 20030196352; 20030217485; 20040019972; 20040039316; and 20040049827 each of the foregoing in United States patent and Patent Publication Nos. is hereby incorporated herein by reference. Each one of these referenced items, however, suffers from one or more of the following disadvantages.

One disadvantage is that they do not use a visco-elastic material having a sufficient density and thickness to provide a relatively uniform pressure to the insole when compressed between the person's foot and footwear.

Another disadvantage is that they do not use a visco-elastic material having a sufficient density and thickness of the visco-elastic material to sustain a person's weight without compressing the visco-elastic material to essentially a zero thickness.

Another disadvantage is that they do not use a visco-elastic material having a sufficient density and thickness of the visco-elastic material to sustain a person's weight without compressing the visco-elastic material to essentially a zero thickness.

Another disadvantage is that they do not use support device covers where the support device is covered support device covers.

SUMMARY OF THE INVENTION

It is an object of the present invention to provide an insole support device adapted to a person's foot and footwear comprising: a visco-elastic material having a sufficient density and thickness to provide a relatively uniform pressure to the insole when compressed between the person's foot and footwear. Preferably, the density and thickness of the visco-elastic material is sufficient to sustain a person's weight without compressing the visco-elastic material to essentially a zero thickness. More preferably, the visco-elastic material is polyurethane material. In a preferred embodiment, the thickness of the visco-elastic material of an insole support device is at least three inches when not compressed and more preferably the thickness of the visco-elastic material is at least eight inches when not compressed. Further, it is preferred to use an insole support device cover wherein the insole support device is covered by insole support device cover, and more preferably, it is object to partially compress the insole support device before being covered by insole support device cover. Other preferred objects of the invention include: an insole support device comprising a sock having a sock insole where the insole support device cover is coupled to the sock insole and insole support device of where the insole support device is coupled to the person's footwear.

Another an object of the present invention to provide a method of distributing pressure on the insole of a person's foot comprising: adapting a visco-elastic material having sufficient thickness and density to a person's foot and footwear, and placing the adapted visco-elastic material between the person's foot and footwear, and preferably the visco-elastic material comprises creating a polyurethane material adapted to fit the person's foot and footwear. Preferably, the person's footwear can be selected from any shoe, boot or foot device, whether ordinary or medical, to which the insole support device can fit.

Another an object of the present invention to provide a walking device having an insole support device comprising a visco-elastic material and an insole support receiving device adapted to receive the insole support device and a person's foot having an insole. Preferably, the insole support device has a sufficient density and thickness to provide a relatively uniform pressure to the insole when compressed between the person's foot and an insole support receiving device. More preferably the insole support receiving device opens to allow the insole support device to be coupled, and most preferably the insole support receiving device is a medical boot. Preferably, the visco-elastic material of the walking boot is a polyurethane material.

Another an object of the present invention to provide a support device that can used to more evenly distribute pressure the leg, butt (ischeal), back (secral), elbow, arm, scalp, or halo (head) of a patient to prevent, treat and heal decubitus.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention (s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

One preferred embodiment of this device is an insole support device that is made from visco-elastic material such as a polyurethane material (sometimes known as a visco-elastic foam or memory foam). These visco-elastic materials are well known and offer a high degree of pressure distribution; for example, the visco-elastic material used in the preferred embodiments of this invention was obtained from a "Memory Foam contour pillow" produced by Sleep Innovations, Inc. (187 Route 36 Suite 201 West Long Branch, N.J.). However, the preferred embodiment is not intended be a limitation of the types of visco-elastic materials or manufactures' products that may be used with this invention.

Figure 5:
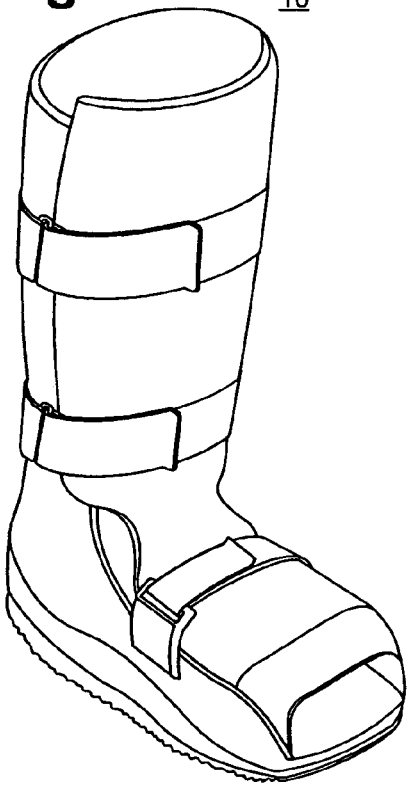
FIG. 5 shows a preferred embodiment of a medical boot.
Figure 6:
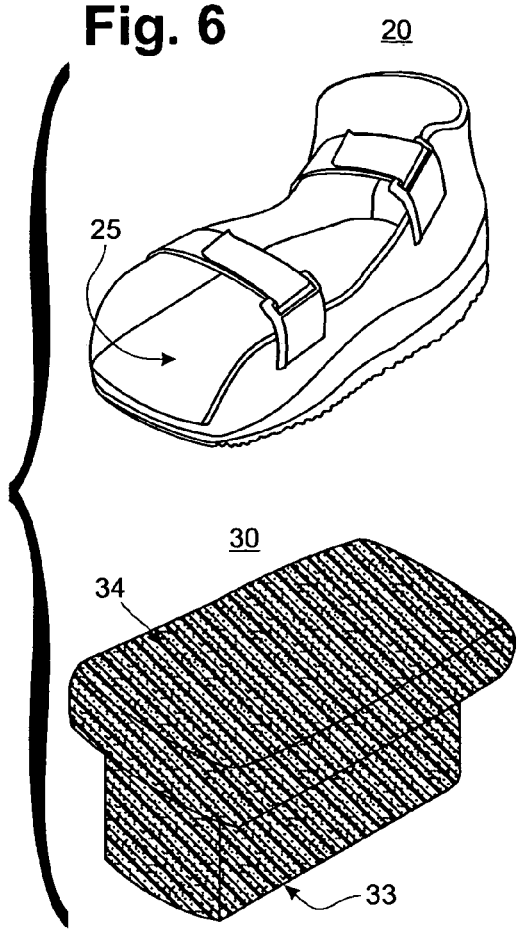
FIG. 6 shows a preferred embodiment of a medical shoe and insole support device.

In this preferred embodiment of this invention, an insole support device was fashioned from the visco-elastic material such that it covered the entire bottom of an adult person's (i.e. patient's) foot and may be formed to fit in a medical boot, medical shoe, standard shoes and boots and other ambulatory footwear (shoe and boots) such as those produced by Apex Foot Health Industries or the many other companies that produce such products. FIGS. 5 and 6 show preferred embodiments of a medical boot 10 and a medical shoe 20. An insole support device 30 of this preferred embodiment is made of the viscoelastic material and formed to have a bottom side 33 and a top side 34 such that the bottom side may be coupled to the walking boot 10 or walking shoe 20. In a preferred embodiment, the bottom side 33 would contact the inner portion 25 of the walking shoe 20 and the user's foot (not shown) would contact the top side 34 to wear the insole support device and walking shoe together. Most preferably, the top side 34 would contact at least part of the sides of the user's foot.

Figure 1:
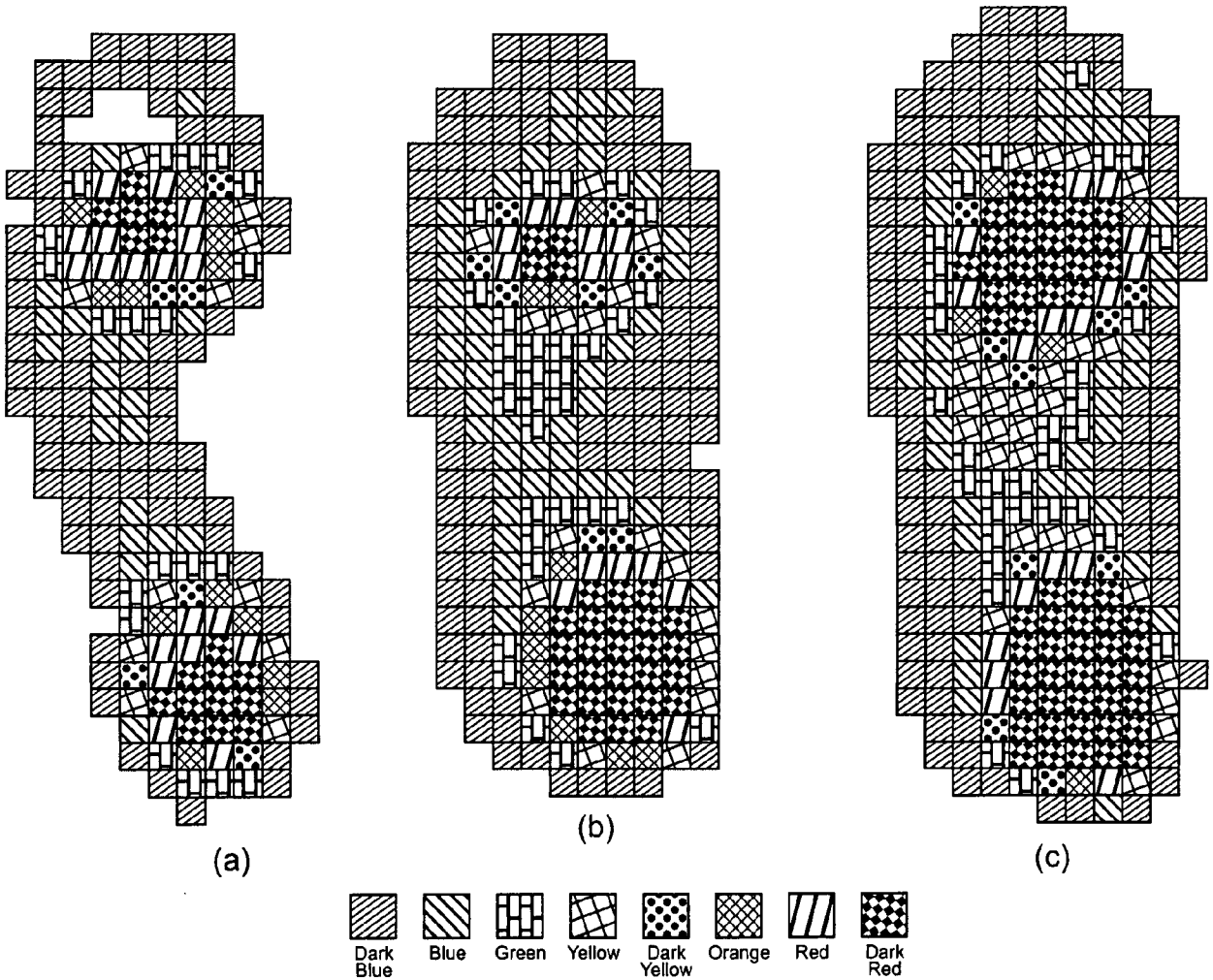
FIG. 1 shows a comparison of one preferred embodiment of the invention using average pressure measurements for a patient's right foot (a) without an insole support device, (b) with an insole support device having a thickness of three inches before compression measured after one minute, and (c) with an insole support device having a thickness of three inches before compression measured after fifteen minutes.
Figure 2:
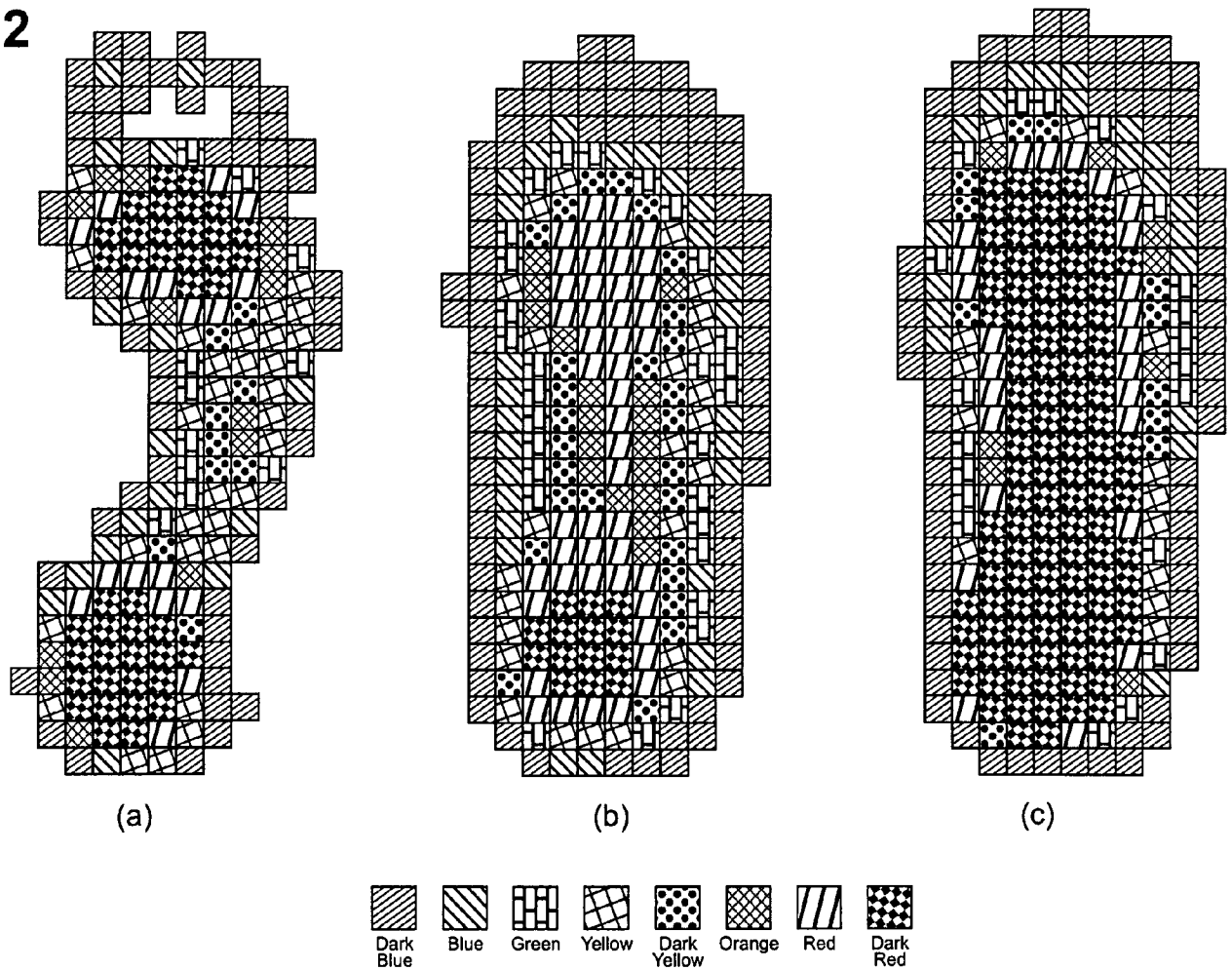
FIG. 2 shows a comparison of another preferred embodiment of the invention using average pressure measurements for a patient's left foot (a) without an insole support device, (b) with an insole support device having a thickness of eight inches before compression measured after one minute, and (c) with an insole support device having a thickness of eight inches before compression measured after fifteen minutes.
Figure 3:
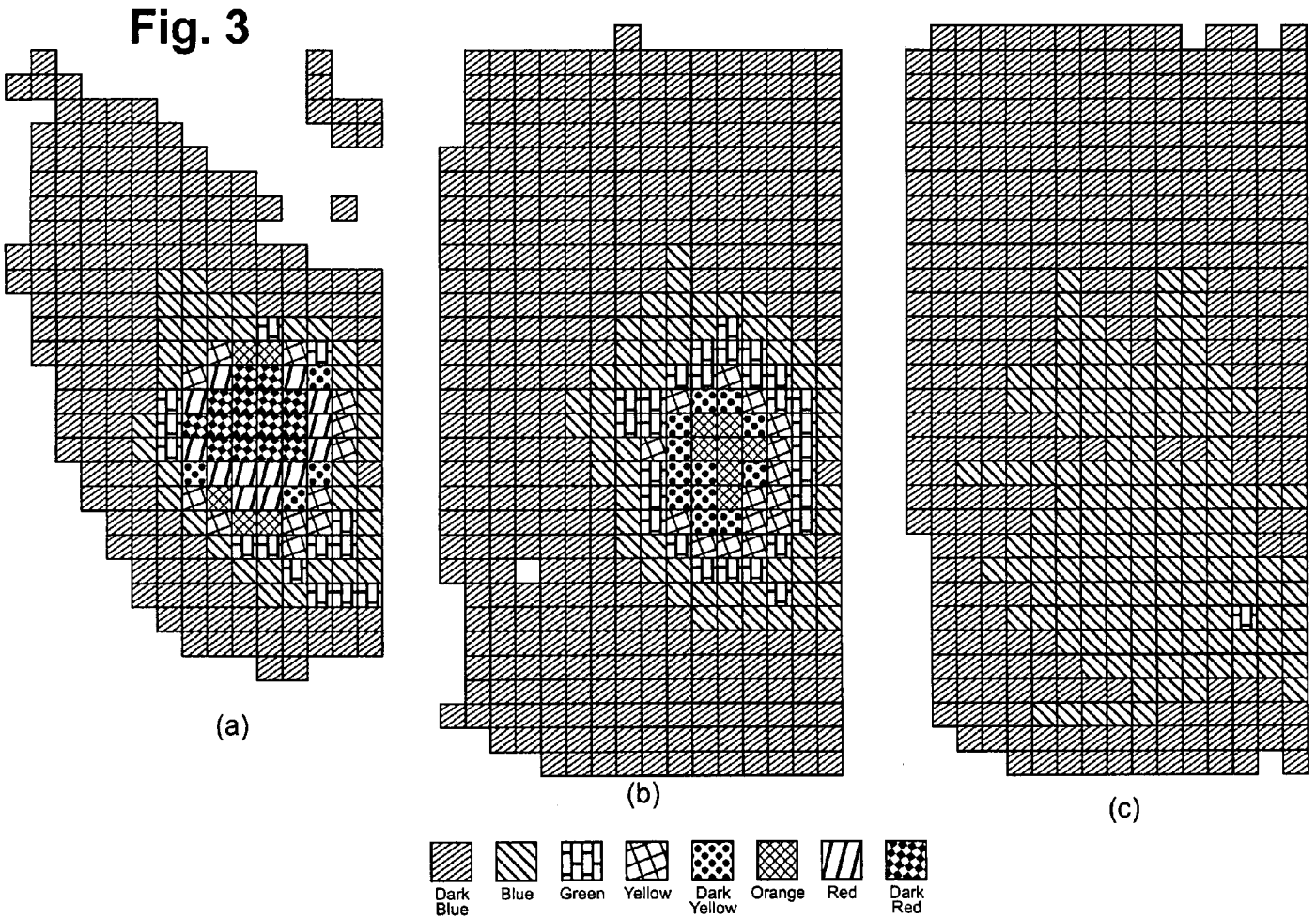
FIG. 3 shows a comparison of another preferred embodiment of the invention using average pressure measurements for a patient's left buttocks (a) without a buttocks support device, (b) with a buttocks support device having a thickness of four inches before compression measured, and (c) with a buttocks support device having a thickness of eight inches before compression.
Figure 4:
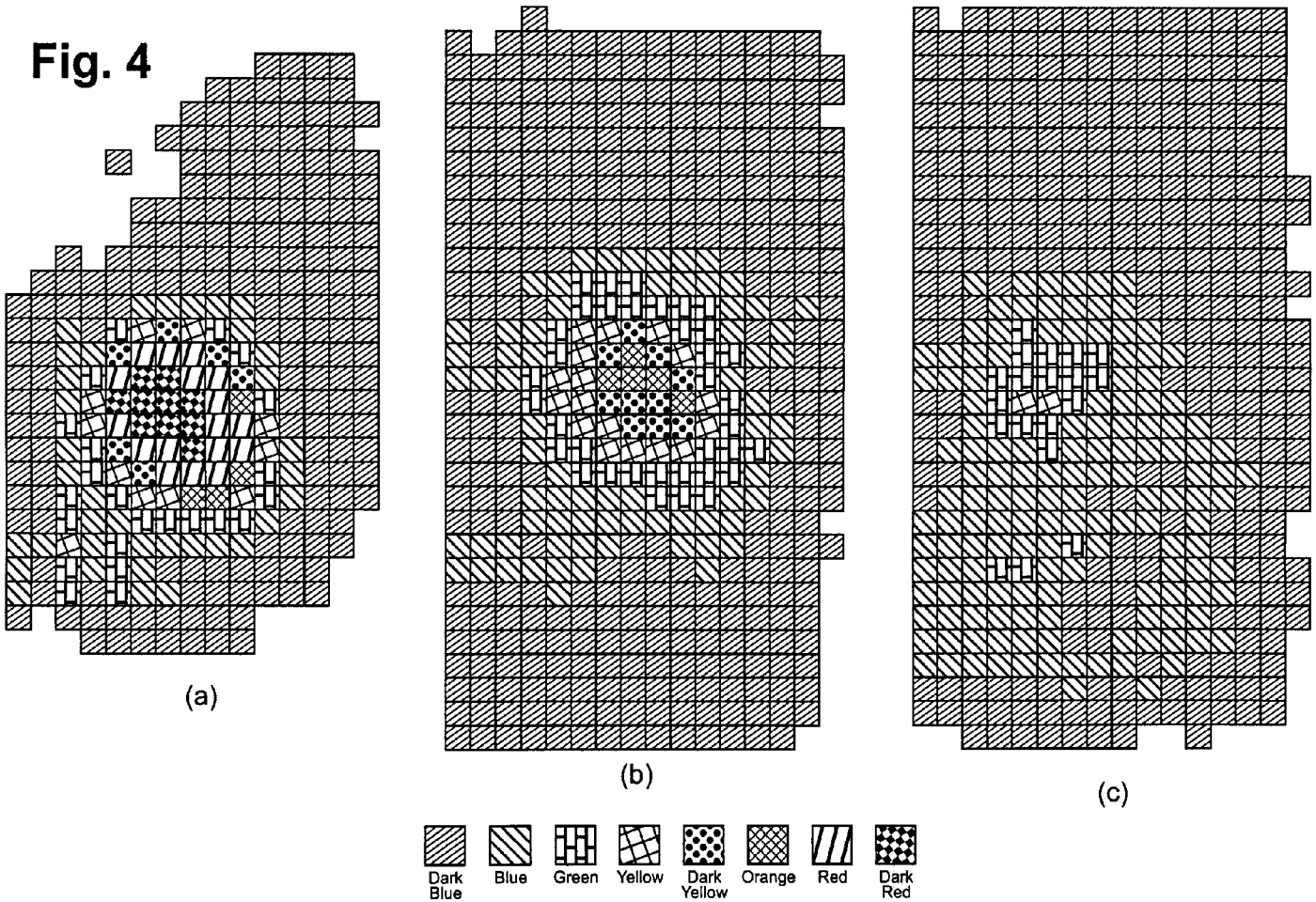
FIG. 4 shows a comparison of another preferred embodiment of the invention using average pressure measurements for a patient's right buttocks (a) without a buttocks support device, (b) with a buttocks support device having a thickness of four inches before compression measured, and (c) with a buttocks support device having a thickness of eight inches before compression.

FIGS. 1 and 2 compare the results of pressure distribution on the foot of a test person as a function of time and thickness. For the examples shown in FIGS. 1 through 4, the same test person was used (a male whose height and weight were approximately 6 foot 4 inch, 225 pound male, respectively). The pressure analysis measurements were made using an iStep system by Apex Health Industries consisting of a baropedometer containing 1024 barosensitive sensors connected to a computer and each corresponding to about a 1 square centimeter area. In the examples, the pressures measured by the sensors are indicated by colors as indicated: white indicates no pressure read by a particular sensor, dark blue which indicates the lowest measurable pressure reading to dark red which indicate the highest measurable pressure reading. It is to be noted that when the maximum range of the sensor is reached any additional pressure on that sensor is not recorded.

As can be seen in FIGS. 1 and 2, the highest pressures (most probably exceeding the limits of individual sensors) are seen at the heel and ball of the person's foot. With the addition of 3 inches of visco-elastic foam, the higher pressure reading spread to more sensors at one minute (b) and fifteen minutes (c). FIG. 2 show an even more dramatic spread of the pressure when using 10 inches of visco-elastic foam at one minute (b) and fifteen minutes (c). Specifically, at fifteen minutes as shown in FIG. 2(*c*) the pressure has spread from the heel to the ball of the foot. Since the exact same patient is used, the changes in pressure over a larger area indicate that the pressure is being spread over a larger contact area thereby lowering the maximum pressure seen at any point.

Preferred embodiments of this invention include covering the visco-elastic material with a support device cover, and specifically an insole support device cover for described preferred embodiment. More preferably, the insole support device cover can be coupled to a sock or the footwear or both. Also preferably, the visco-elastic material may be partially compressed and covered by the insole support device cover to hold it in this partially compressed state. The reduced thickness of partially compressed covered insole support device may make it easier to place the person's foot in the footwear.

Figure 7:
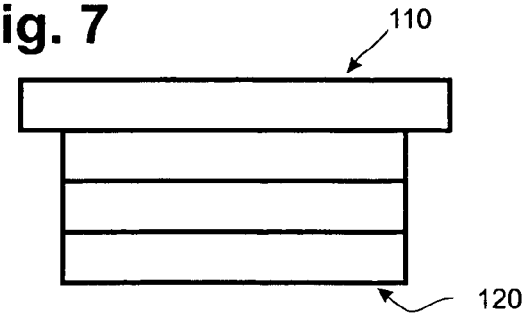
FIG. 7 shows a side view of a preferred embodiment of a buttocks support device.

In another preferred embodiment of the invention, a buttocks support device is formed for a seating device for a person. In a preferred embodiment, the seating device is a wheelchair and the buttocks support device is at least four inches thick, and in a most preferred embodiment the buttocks support device is at least eight inches thick. FIG. 7 shows a side view of a buttocks support device for a wheelchair that is eight inches thick having a seat side 120 and a buttocks side 110 and made of 4 two inch sections. In the most preferred embodiment of the invention, the seat side 120 would contact the seat of the wheelchair and the buttocks side 110 would contact the user's buttocks. Most preferably, the buttocks side 110 would contact at least part of the sides of the user's buttocks and/or legs.

While it is to be understood that the above preferred embodiment is directed to a insole support device, other support devices for heel, leg, butt, back, body, elbow, arm, scalp, or halo (head) may be fashioned so long as they use a visco-elastic material having sufficient density and thickness to provide a relatively uniform pressure on the affected area.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. An insole support device adapted to footwear comprising: a visco-elastic material having a thickness of at least eight inches when not compressed to provide a relatively uniform pressure to an insole of a person's foot when compressed between the person's foot and footwear.

2. The insole support device of claim 1 wherein the visco-elastic material is polyurethane material.

3. The insole support device of claim 2 further comprising an insole support device cover wherein the insole support device is covered by insole support device cover.

4. The insole support device of claim 3 wherein the insole support device is partially compressed before being covered by insole support device cover.

5. The insole support device of claim 3 further comprising a sock having a sock insole wherein the insole support device cover is coupled to the sock insole.

6. The insole support device of claim 5 wherein the insole support device is partially compressed before being covered by insole support device cover.

7. The insole support device of claim 2 wherein the insole support device is coupled to the person's footwear.

8. The insole support device of claim 2 further comprising an insole support device cover wherein the insole support device is covered by insole support device cover and the insole support device cover is coupled to the person's footwear.

9. The insole support device of claim 8 wherein the insole support device is partially compressed before being covered by insole support device cover.

10. A walking device comprising: an insole support device comprising a visco-elastic material and an insole support receiving device adapted to receive the insole support device and a person's foot having an insole; wherein the insole support device has a thickness of at least eight inches when not compressed to provide a relatively uniform pressure to the insole when compressed between the person's foot and an insole support receiving device.

11. The walking device of claim 10 wherein the insole support receiving device is a medical boot or medical shoe.

12. The walking device of claim 10 wherein the visco-elastic material is a polyurethane material.

13. The walking device of claim 11 further comprising an insole support device cover wherein the insole support device is covered by insole support device cover.

14. The walking device of claim 13 wherein the insole support device is partially compressed before being covered by insole support device cover.

15. The walking device of claim 13 further comprising a sock having a sock insole wherein the insole support device cover is coupled to the sock insole.

16. The walking device of claim 15 wherein the insole support device is partially compressed before being covered by insole support device cover.

17. The walking device of claim 11 wherein the insole support device is coupled to the medical boot or medical shoe.

18. The walking device of claim 11 further comprising an insole support device cover wherein the insole support device is covered by insole support device cover and the insole support device cover is coupled to the medical boot.

19. The walking device of claim 18 wherein the insole support device is partially compressed before being covered by insole support device cover.

* * * * *